US008042356B2

(12) United States Patent
Norris et al.

(10) Patent No.: US 8,042,356 B2
(45) Date of Patent: Oct. 25, 2011

(54) BEVERAGE CONTAINER DRINKING SURFACE ENHANCEMENT

(75) Inventors: Joseph T. Norris, Cumming, GA (US); Rony Zibara, New York, NY (US); Mark Payne, Woodstock, NY (US); Jared Richardson, New York, NY (US); Jon Crawford-Phillips, Brooklyn, NY (US); Darryl J. Dawson, Sr., Stockbridge, GA (US)

(73) Assignee: The Coca-Cola Company, Atlanta, GA (US)

( * ) Notice: Subject to any disclaimer, the term of this patent is extended or adjusted under 35 U.S.C. 154(b) by 0 days.

(21) Appl. No.: 12/603,659

(22) Filed: Oct. 22, 2009

(65) Prior Publication Data

US 2010/0095696 A1 Apr. 22, 2010

Related U.S. Application Data

(60) Provisional application No. 61/107,509, filed on Oct. 22, 2008.

(51) Int. Cl.
*F25D 3/08* (2006.01)

(52) U.S. Cl. ..... 62/457.3

(58) Field of Classification Search ..... 62/457.3, 62/457.4, 457.8, 259.1, 452; 220/592.17, 220/521, 711; 426/330.3, 584, 524, 397
See application file for complete search history.

(56) References Cited

U.S. PATENT DOCUMENTS

| | | | | |
|---|---|---|---|---|
| 3,765,559 | A * | 10/1973 | Sauey et al. | 220/592.16 |
| 3,942,660 | A | 3/1976 | Paller | |
| 5,063,754 | A * | 11/1991 | Chou | 62/457.9 |
| 5,609,039 | A * | 3/1997 | Green et al. | 62/457.3 |
| 5,785,204 | A * | 7/1998 | Thompson et al. | 221/24 |
| 6,221,301 | B1 * | 4/2001 | Tsunashima et al. | 264/466 |
| 6,279,794 | B1 * | 8/2001 | Miyazaki | 224/148.7 |
| 6,817,202 | B1 * | 11/2004 | Anthony | 62/293 |
| 6,986,435 | B2 | 1/2006 | Sagal et al. | |
| 7,082,784 | B2 | 8/2006 | Roth et al. | |
| 2006/0010903 | A1 * | 1/2006 | Porter | 62/457.3 |
| 2007/0080162 | A1 | 4/2007 | Miller | |
| 2009/0108006 | A1 * | 4/2009 | Milan | 220/592.17 |

OTHER PUBLICATIONS

International Search Report from Corresponding PCT Application PCT/US2010/050684.

* cited by examiner

*Primary Examiner* — Mohammad Ali

(57) ABSTRACT

A thermally conductive polymeric drinking surface for a beverage container is provided. The thermally conductive polymeric drinking surface may be an insert for a bottle or other covering configured to be formed around the mouth of a drinking container, such as a cup. The high thermal conductivity of the drinking surface contributes to the transfer of the temperature of the contents of the container to the mouth or lips of the consumer by reducing the time and energy consumption of the chilling processes being applied via the beverage or an external cooling mechanism.

17 Claims, 6 Drawing Sheets

BEVERAGE CONTAINER DRINKING SURFACE ENHANCEMENT

FIELD OF THE INVENTION

The present invention pertains to containers, and more particularly relates to a container for cold beverages, having a thermally conductive drinking surface that reduces the temperature gradient between the beverage and the drinking surface that comes into contact with the consumer's lips or mouth providing a cold feel to the lips or mouth similar to coldness of beverage.

BACKGROUND OF THE INVENTION

Plastic bottles, glass bottles, aluminum cans and cups made from various materials ranging from paper to plastic to metal, are commonly used as beverage containers. These containers come in a variety of shapes, sizes and configurations. For cold beverages, one advantage of metal based containers, such as aluminum cans, is that the aluminum surface of the can provides the drinker with a cool drinking surface that provides the drinker's lips or mouth with the cold feeling or sensation of a cold beverage contained therein. What is therefore desired is an improved drinking surface for non-metallic containers that provides a cold drinking sensation similar to that of an aluminum can. It is also desired to provide a container having a drinking surface that has a temperature similar to that of the beverage inside the container to provide the consumer with a cool refreshing drinking sensation when the drinking surface comes into contact with the consumer's lips or mouth, thereby enhancing the overall beverage drinking experience of the consumer.

SUMMARY OF THE INVENTION

The present invention is directed to a thermally conductive polymeric drinking surface for a beverage container. The container may be a bottle, cup or other suitable container. The thermally conductive polymeric drinking surface may be an insert for a bottle or a covering configured to be formed over the mouth of a container.

A beverage container according to the invention is characterized by a surface, particularly, a thermally conductive polymeric surface member, that provides a cold temperature similar to that of the cold beverage in the container to the mouth or lips of the consumer. This may be achieved by a container made of a material that has high thermal conductivity and provides a low temperature gradient to reduce the time and energy of the chilling processes being applied to the material via the beverage or an external cooling mechanism, such as a refrigerator or ice bath.

In addition, the beverage container has an advantage over conventional non-metallic containers by providing a cold drinking surface similar to that of an aluminum can.

BRIEF DESCRIPTION OF THE INVENTION

DETAILED DESCRIPTION

Thermally conductive polymer based materials, particularly polyethylene terephthalate (PET) and polypropylene based materials have been found to be sufficiently thermally conductive and have the appropriate food and beverage contact requirements that allow them to be used in direct contact with food and beverages, including consumable water.

Figure 1:
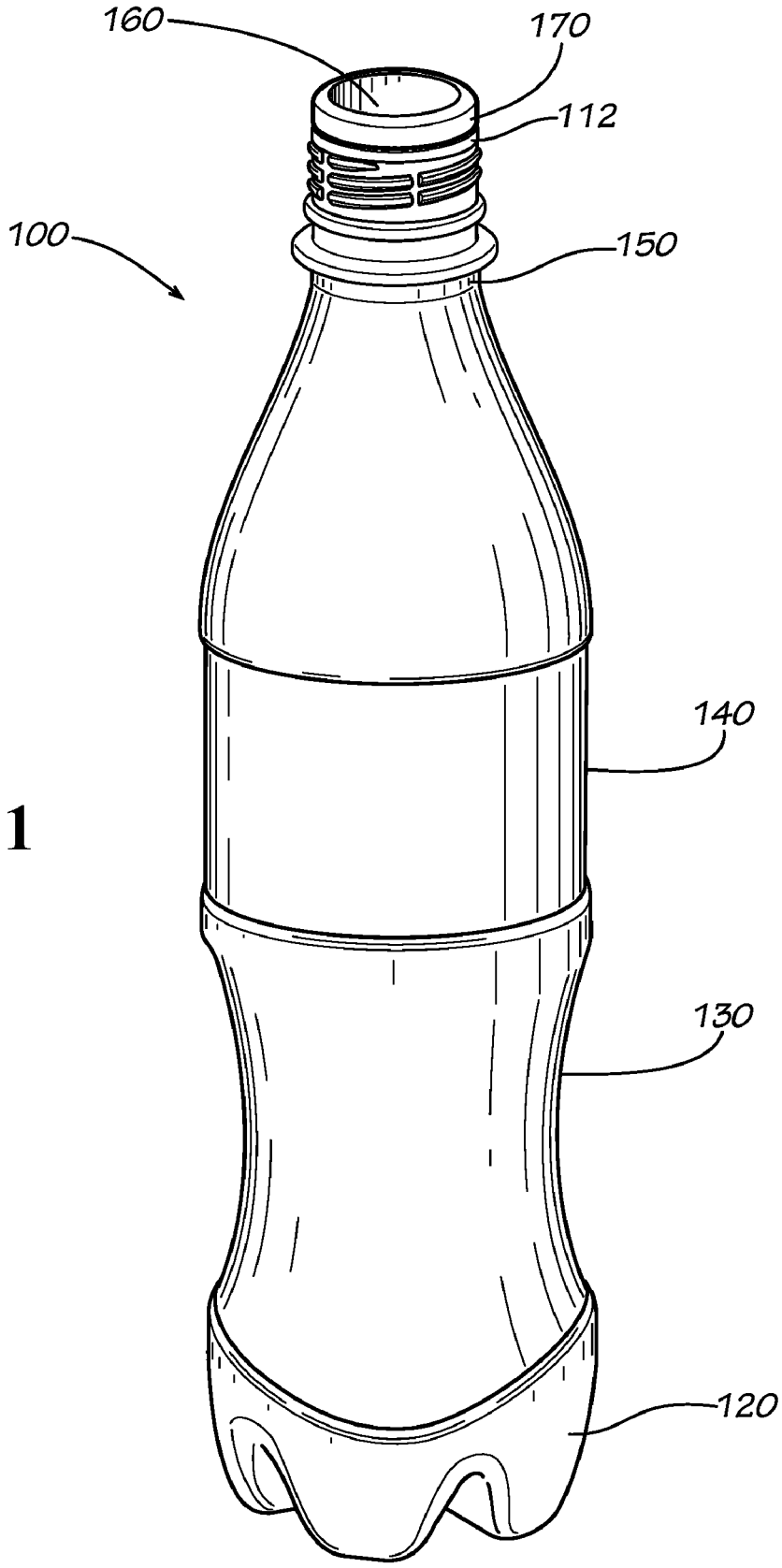
FIG. 1 is a perspective view of a container in accordance with the invention.
Figure 2:
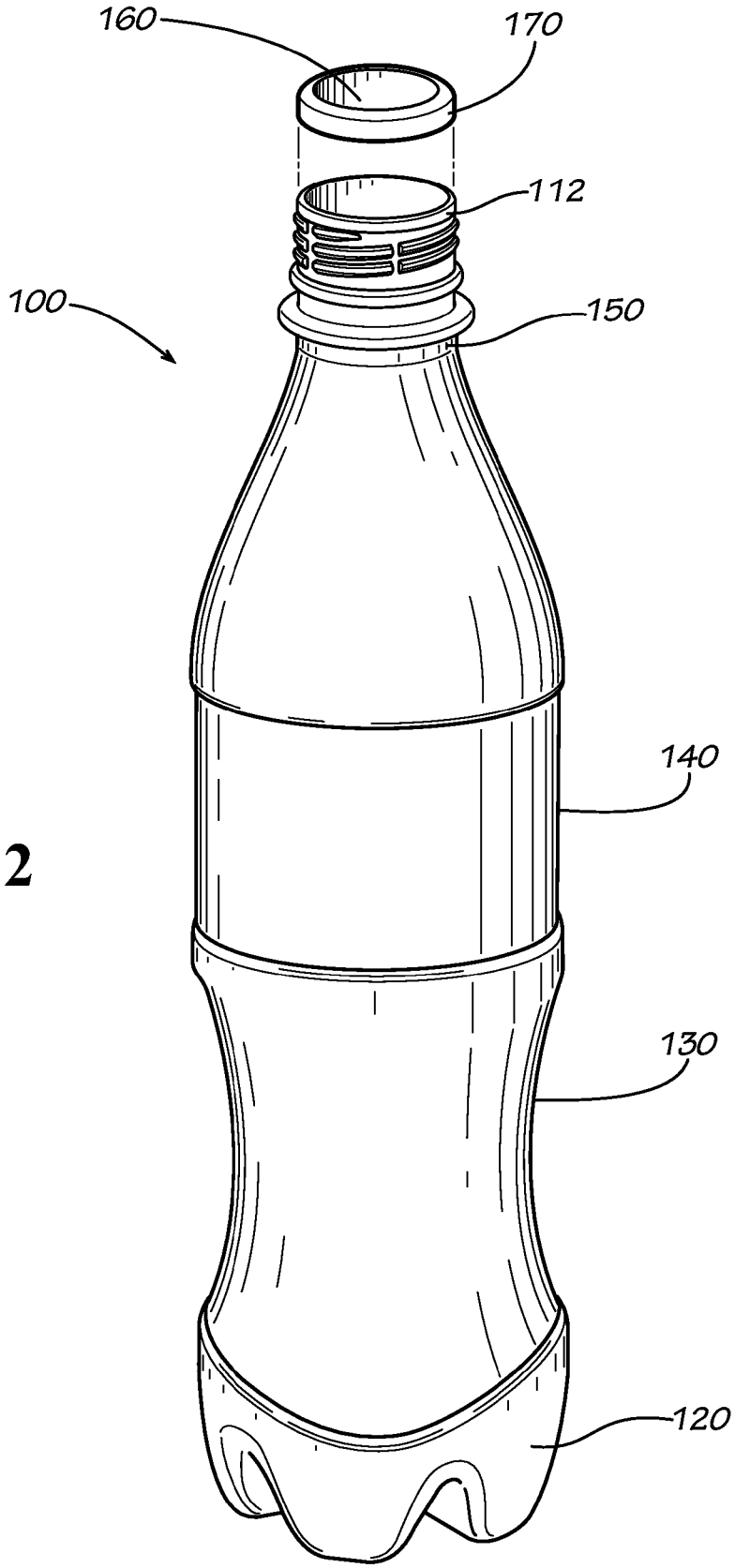
FIG. 2 is a perspective view of a container showing a drinking surface in accordance with the invention detached from the container.

Referring now to the drawings in detail, in which like numerals refer to like elements throughout the several views respectively. FIGS. 1-2 are perspective views, of a container having a cooling surface member in accordance with one embodiment of the invention. As shown, the container may be a bottle 100, which includes a base 120, a grip portion 130, a label portion 140, a neck 150 and a cooling surface member 170 having a surface opening 160 formed therein. In one embodiment of the invention, shown in FIG. 3, the cooling surface member 170 is an insert having an attached cooling anchor section 172 for insertion into an opening 112 in the mouth 112 of bottle and an external section of the cooling surface member 170' extending away from cooling anchor section 172 and over the mouth 112 of the bottle for contact with a consumer's lips or mouth.

The cooling surface member 170 may be formed from any suitable thermally conductive thermoplastic material. Preferably, the thermally conductive thermoplastic material reduces the temperature gradient between the beverage and the cooling surface member to 3 degrees or less. A preferred thermally conductive thermoplastic material has high thermal conductive properties. A preferred modified resin for forming the thermoplastic material may comprises a base polymer of polypropylene, polyester or polyamide (Nylon). It should be understood that the cooling surface member 170 may be formed by any suitable means including molding from a phase changing material, a polymeric material controlled by endothermic reactions, or a plastic or polymeric material that is designed to absorb and/or retain cold temperatures. Preferred thermally conductive thermoplastic materials can be molded into various shapes via conventional injection molding techniques. However, any suitable thermoplastic processing technique may be used, including, but not limited to, extrusion.

In a preferred embodiment of the invention, the cooling surface member 170 is a thermally conductive thermoplastic material having a material thermal conductivity about 1 W/mK to about 1500 W/mK (Watts per meter Kelvin), preferably of from about 1 W/mK to about 200 W/mK, and more preferably of from about 2 W/mK to about 20 W/mK. The preferred thermal diffusivity is from about 0.05 $cm^2$/sec to about 0.12 $cm^2$/sec, and the preferred density is from about 1.24 g/cc-1.56 g/cc. Accordingly, in one embodiment of the invention, a preferred thermally conductive thermoplastic material would be engineered to provide a material thermal conductivity of from about 2 W/mK to about 20 W/mK (Watts per meter Kelvin) a thermal diffusivity of from about 0.05 cm2/sec to about 0.12 cm2/sec and a density of from about 1.24 g/cc-1.56 g/cc. A preferred thermally conductive thermoplastic material has a hardness range from Shore A 40 to Shore D 80.

Now referring again to FIGS. 1-2, the bottle 100 may be made out of any suitable material. For example, the bottle may be plastic or glass. In one embodiment the bottle is plastic and formed from a polymer based thermoplastic material. Conventional plastic has a material thermal conductivity of about 0.2 W/mK. A preferred thermoplastic material is PET (polyethylene terephthalate). Other suitable thermoplastic materials include PLA (polylactic acid), polypropylene, bio-based polymeric materials or combinations thereof. In another embodiment the bottle 100 may be a made from silica or other glass forming material.

The neck portion 150 also may be of any suitable design. The neck portion 150 may be tapered or have other desired designs or shapes. Preferably, the neck 150 terminates at one end to form the mouth 112 of the bottle 100. The cooling surface member 170 having a cooling surface opening 160 formed therein is connected to cover the mouth 112 of the bottle 100 and allow fluid communication between the surface opening 160 and the mouth 112 of the bottle.

In an embodiment of the invention, the cooling surface member 170 is annular in shape and preferably has a substantially ringed shape with a void or opening in the center, which forms the cooling surface opening 160. However, it should be understood that in accordance with the invention, a cooling surface member may be any desirable shape that can provide an opening therein and be configured to conform to cover a mouth of a bottle or container while allowing fluid communication between said opening and the mouth of the bottle. As such, a cooling surface opening in accordance with the invention also may be of any suitable design or shape.

Figure 3:
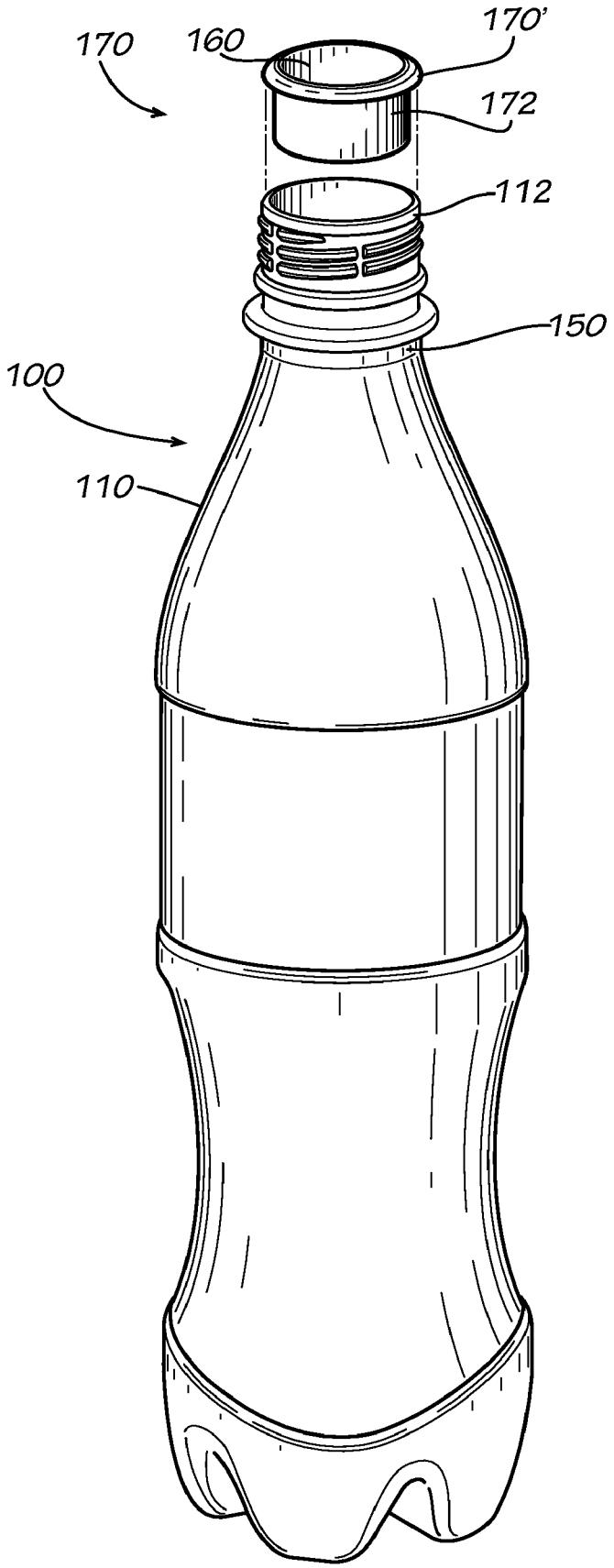
FIG. 3 is a perspective view of a container showing a drinking surface insert in accordance with the invention detached from the container.
Figure 3A:
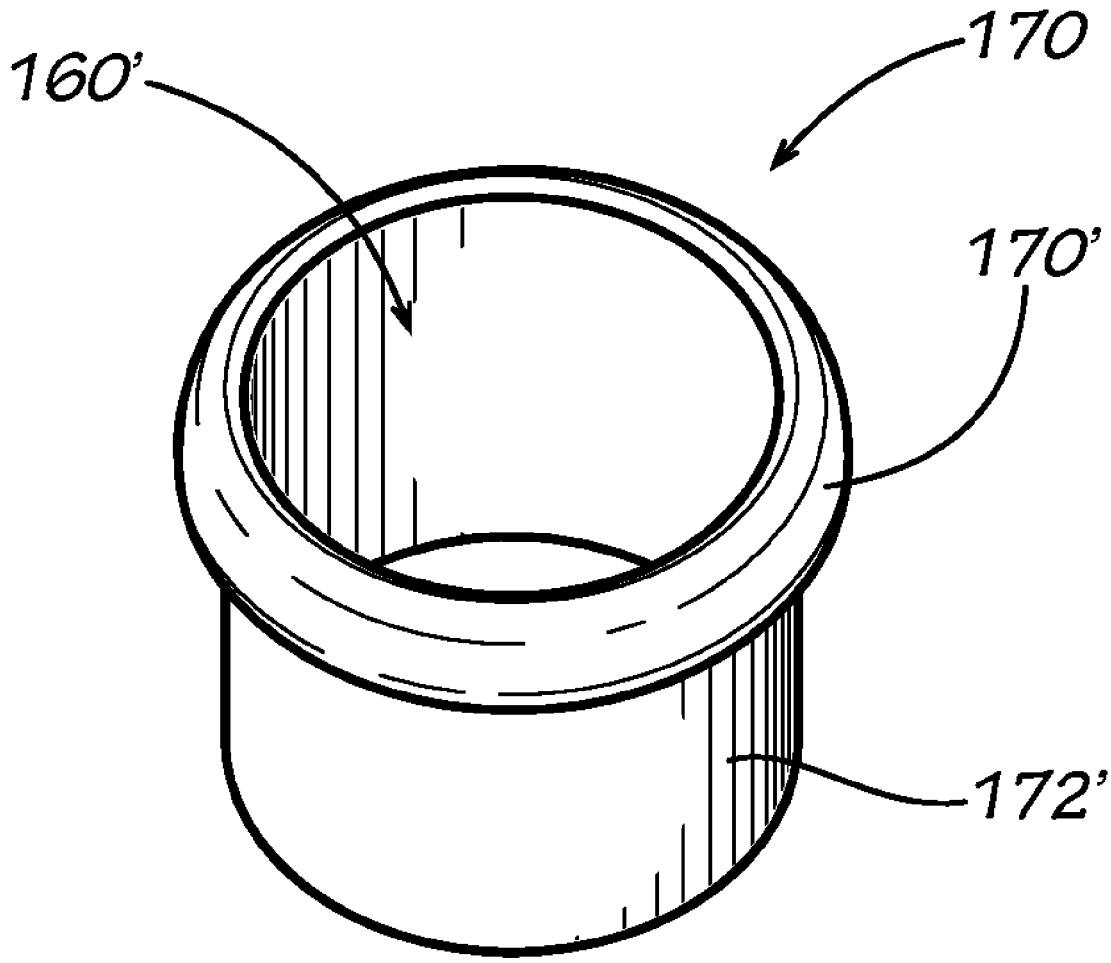
FIG. 3A is an expanded partial cross-sectional view taken through the opening of a the drinking surface insert shown in FIG. 3

The cooling surface member 170 may be attached to the neck 150 of the bottle 100 by any suitable means. As shown in FIG. 3. the cooling surface member 170 is preferably an insert that is fabricated to have a first section for providing an external cooling surface 170' covering the mouth 112 of the bottle and providing a drinking surface for contact with a consumer's mouth or lips; and a second section for providing a cooling anchor section 172 for insertion into the mouth and neck 150 of the bottle 112. FIG. 3A shows an expanded view of an insertable cooling surface member 170, having an external cooling surface 170' for covering the mouth 112 of the bottle 100, a cooling anchor section 172' and the cooling surface opening 160' formed therein.

In one embodiment, the cooling anchor section 172 is formed to have an interference fit. In another embodiment, the cooling surface member 170 is attached to a plastic container by crimping the cooling surface member over the top of a flange that can be designed in the container. In yet another embodiment, the cooling surface member 170 may be attached to the neck 150 of a container by integrally forming the cooling surface member 170 to the neck 150 by adhesion or fusion methods. In the case of plastic bottles, the cooling surface member 170 may also include a number of threads (not shown) such that a cap may be positioned thereon so as to close the bottle 100.

In yet another embodiment of the invention, the cooling surface member 170 may be attached to the neck via a designed interference fit or barbs used to create an interference and anchor the cooling surface member 170 inside the neck 150 of a glass bottle. In yet another embodiment, the cooling surface member 170 can fit on a glass bottle, via a designed interference fit by forming the cooling surface member 170 from a thermoplastic elastomer (TPE) to create a compression fit and seal.

Preferably, the cooling surface member 170 is fabricated separately from the bottle 100 and is inserted into the neck 150 either before or after filling the bottle 100 with the desired beverage. As described previously, the cooling surface member 170 may fit by a designed interference or a simple crimp over the top of a flange designed on a container. However, it is to be understood that various methods of incorporating the cooling surface member into the neck of a bottle or container may be used and still be within the scope of this invention.

The cooling surface member 170 may also be designed to maximize the surface area that is in contact with the beverage during drinking, thereby enhancing its ability to reduce the temperature gradient between the beverage and the surface thereby transmitting a colder temperature to the cooling surface opening 160. Preferably, the surface area of the cooling anchor section 172 of a cooling surface member 170 would generally not be visible to the consumer from the exterior of the bottle 100, but would sit inside the neck 150 of the bottle 100. However, for design purposes it is to be understood that the cooling anchor section 172 may be designed to be visible. For example, the cooling anchor section 172 can be formed with threads for attaching a closure, in which case the cooling anchor section 172 would be visible. It should be understood that closures and finishes for the neck 150 can be adjusted to compensate for the height of the neck 150 of the bottle 100 to maintain an effective seal.

In a preferred embodiment of the invention, the cooling surface member 170 is molded in a thermally conductive polymer, and after molding, the component is inserted into the neck 150 of a container or bottle 100.

Figure 4:
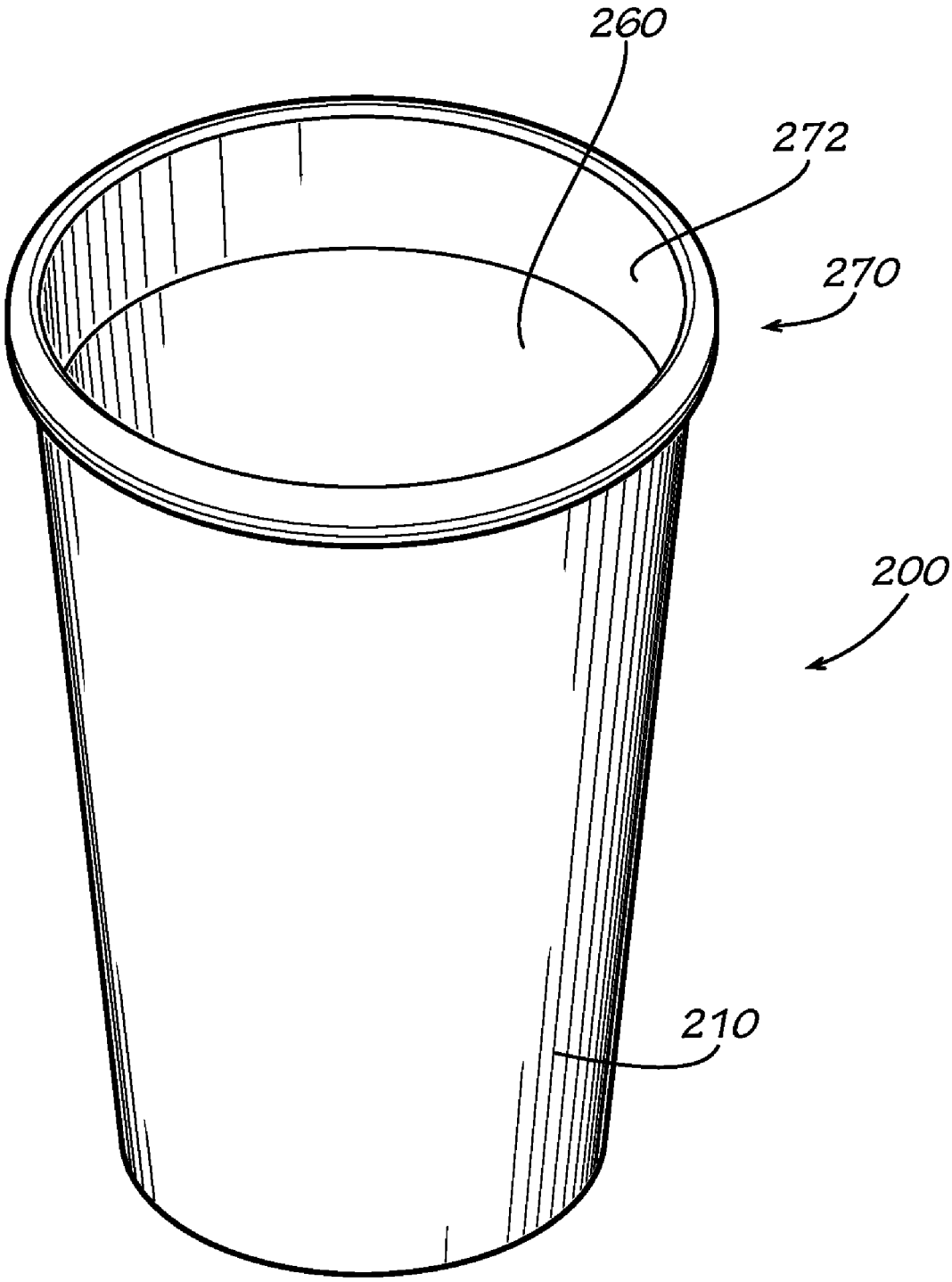
FIG. 4 is a perspective view of a container in accordance with another embodiment of the invention.
Figure 4A:
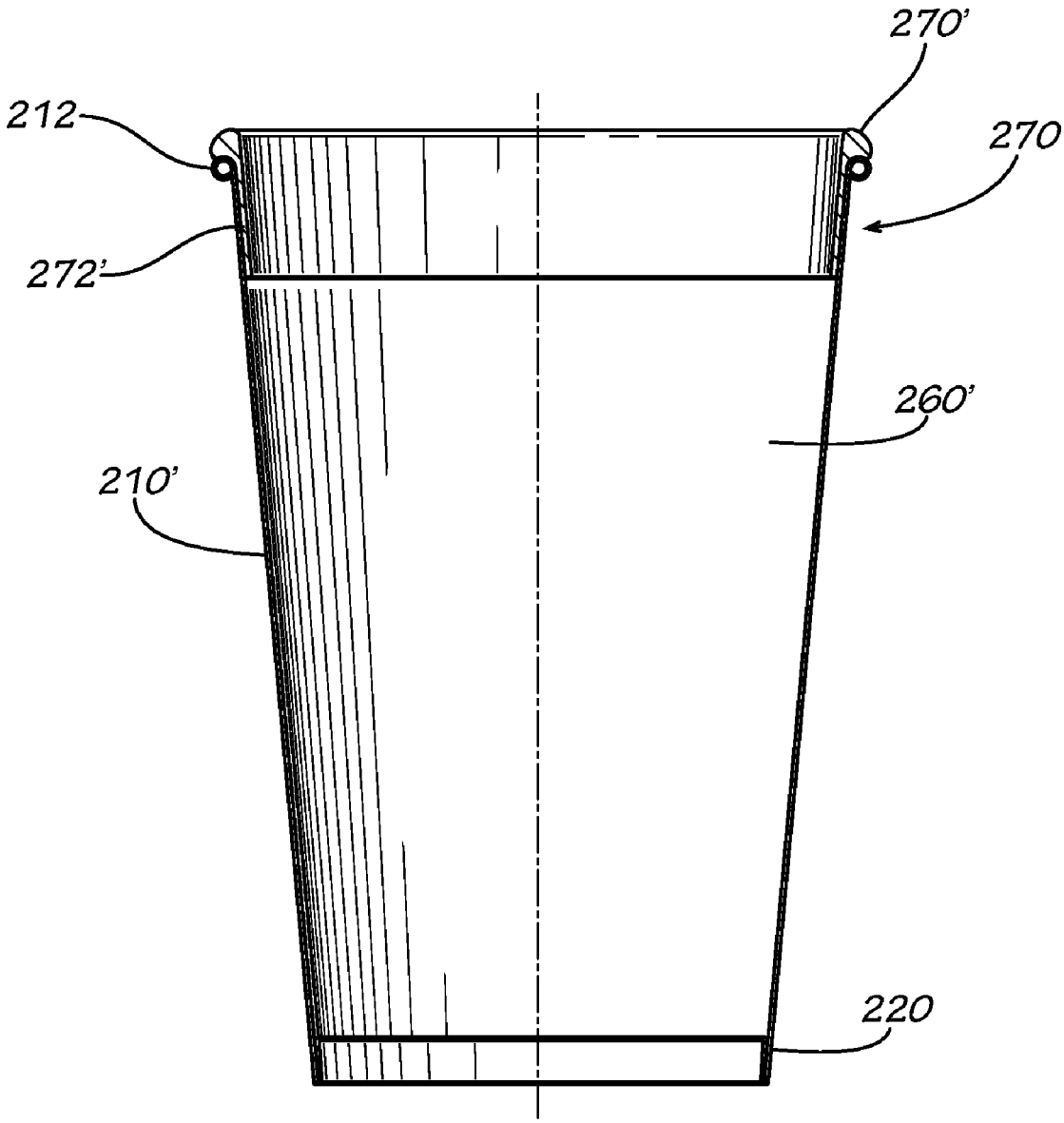
FIG. 4A is a cross-sectional of FIG. 4.

FIGS. 4 and 4A show a perspective view and a cross-sectional view respectively, of a container that is preferably a cup 200. The cup may be disposable or non-disposable and accordingly, may be formed of any suitable material, including, but not limited to, polymeric materials, such as polypropylene, polyethylene terephthalate (PET) based polyesters and polystyrenes; paper based materials; and non-disposable materials, such as silica, ceramic, glass or the like.

Referring now again to FIGS. 4 and 4A, there is shown a container, having the shape of a cup 200. The cup 200 has a frusto-conical wall 210, an opening 260 at the top and a base 220 to form the bottom of the cup. A cooling surface member 270 formed of a thermally conductive thermoplastic material has an anchor section 272 configured to adhere to an upper section of the container 200 and extend to cover at least a portion of the external surface of the mouth of the cup 200. As shown in FIG. 4A the mouth 212 of the cup may be curled or curved. The cooling surface member 270 is fixedly attached to the cup such that an anchor section 272' fits inside the container and a flange portion extending away from the anchor section 272' is formed to extend outside of the container and form a cover surface 270' at least partially around the mouth surface 212 of the cup 200.

The cooling surface member 170 or 270 of the invention forms a new, enhanced drinking surface capable of providing a drinking surface having a temperature similar to that of the beverage that comes into contact with it or the temperature provided by a cooling device. While not wishing to be held to one theory, in practice, it is believed that the cold temperature of the beverage inside of a container having a cooling surface member 170 or 270 of the invention formed thereon, provides thermal energy to the thermally conductive thermoplastic material of the cooling surface member 170 or 270 and lowers the temperature of the cooling surface member 170 or 270 to a temperature closer to that of the beverage which in comparison is lower than the temperature of the container.

Alternatively, cold temperature provided by equipment, such as a refrigerator, vending machine, or ice, may also lower the temperature of the cooling surface member 170 or 270. A cold beverage, such as those dispensed from a vending machine or a refrigerator, is able to lower the temperature of the cooling surface member 170 or 270 to below the temperature of the container and thus when the cooling surface member 170 or 270 is in contact with the consumer's lips or mouths, the consumer is provided with a cold and refreshing experience that is not be experienced by contact with the surface of the container.

Each time a consumer drinks from the bottle, the cooling surface member 170 or 270 is recharged or re-cooled via the cold beverage, which enables the consumer to continue receiving the benefit of a cool drinking surface. The design of this cooling surface member 170 or 270 also provides a comfort edge for the consumer to drink from and is an enhancement over current conventional plastic bottles that have sharper edges and threads protruding in this area.

It should be apparent that the foregoing relates only to the preferred embodiments of the present application and that numerous changes and modifications may be made herein by one of ordinary skill in the art without departing from the general sprit and scope of the invention as defined by the following claims and equivalents thereof.

What is claimed:

1. A container mouth surface cover comprising a cooling surface member having an opening therein, said cooling surface member configured to conform to and at least partially cover a mouth of a container, while providing a fluid passageway between said cooling surface member, said opening and the container; said cooling surface member comprising a thermally conductive thermoplastic material having a material thermal conductivity of from about 2 W/mK to about 200 W/mK and a thermal diffusivity of from about 0.05 $cm^2$/sec to about 0.12 $cm^2$/sec.

2. The container mouth surface cover of claim 1, wherein said cooling surface member has a density of from about 1.24 g/cc to about 1.56 g/cc.

3. The container mouth surface cover of claim 1, further comprising a cooling anchor section fixedly attached to said cooling surface member whereby said fluid opening extends through said anchor section providing a fluid passageway between said cooling surface member, said opening, said cooling anchor section and said container; whereby said cooling anchor section is configured for insertion into said mouth of said container.

4. The container mouth surface cover of claim 1, wherein said cooling surface member is designed for contact with a consumer's lips or mouth.

5. The container mouth surface cover of claim 1, wherein a cooling mechanism providing cooling to a temperature lower than an initial temperature of said cooling surface member is provided to reduce the temperature of said cooling surface member and reduce the initial temperature of the cooling surface member.

6. The container mouth surface cover of claim 5, wherein said cooling mechanism is a beverage inside of the container that contacts said cooling surface member.

7. The container mouth surface cover of claim 6, wherein said cooling surface member and said beverage have a temperature gradient of 3 degrees or less.

8. The container mouth surface cover of claim 5, wherein said cooling mechanism comprises a refrigerator, a freezer, ice, a beverage vending machine, a cooler, a cold beverage dispenser, or a combination thereof.

9. The container mouth surface cover of claim 6, wherein each time said beverage contacts said cooling surface member having a non-contact temperature, the non-contact temperature of said cooling surface member is reduced.

10. A container comprising: a mouth having an external drinking surface for contacting a consumer's lip or mouth; a beverage containment unit in fluid communication with the mouth; a base forming a bottom of the beverage containment unit and configured to support the beverage containment unit to stand upright; and a drinking surface cover member in fluid communication with the mouth and the beverage containment unit, the drinking surface cover member having an external surface that covers the external drinking surface of the mouth and provides another surface for contacting a consumer's lip or mouth, and wherein the drinking surface cover member comprises a thermally conductive thermoplastic material having a material thermal conductivity of from about 2.1 W/mK to about 20 W/mK; a thermal diffusivity of from about 0.05 $cm^2$/sec to about 0.12 $cm^2$/sec; and a density of from about 1.24 g/cc to 1.56 g/cc.

11. The container of claim 10, wherein the mouth comprises polyethylene terephthalate, polylactic acid, polypropylene, polystyrene, polystyrene foam, polycarbonate, bio-based polymeric materials, silica, glass, ceramic, paper based materials, or combinations thereof.

12. The container of claim 10, wherein the drinking surface cover member consists essentially of an insert that is fabricated to have a first section for providing the external surface that covers the external drinking surface of the mouth and a second section for providing an anchor section for fixedly attaching the insert into the mouth.

13. The container of claim 12, wherein the beverage containment unit is a bottle comprising a neck in fluid communication with the mouth or a cup.

14. The container of claim 13, wherein the beverage containment unit is a bottle having a beverage contained therein, wherein the second section is designed to maximize a surface area within the neck that contacts the beverage during drinking.

15. A system for use with a consumable beverage, the system comprising: a container having a mouth; a drinking surface comprising a thermally conductive material connected to extend within said container and conformed outward of said container to cover at least a portion of an external section of said mouth, the drinking surface providing a generally rigid nondeformable smooth surface for contacting a consumer's lip or mouth when drinking the consumable beverage, the consumable beverage having a first position in which the consumable beverage is secured within the container until the consumable beverage is poured, and a second position in which the consumable beverage flows from the container and contacts the drinking surface when it is poured over at least a portion of the drinking surface; wherein said drinking surface has a first temperature when said consumable beverage is in said first position and wherein said drinking surface has a second temperature when said consumable beverage is in said second position and further wherein said container has a container temperature; wherein a temperature gradient between said second temperature of the drinking surface and the temperature of the consumable beverage is 3 degrees or less when said consumable beverage is in said second position; wherein the thermally conductive thermoplastic material has a material thermal conductivity of from about 2 W/mK to about 200 W/mK and a thermal diffusivity of from about 0.05 $cm^2$/sec to about 0.12 $cm^2$/sec.

16. The system of claim 15, wherein the drinking surface second temperature is lower than said container temperature.

17. The system of claim 15, wherein the temperature gradient between said second temperature of the drinking surface and the temperature of the consumable beverage is brought to 3 degrees or less each time said consumable beverage flows from said first position to said second position.

* * * * *